US009293247B2

(12) United States Patent
Friebe et al.

(10) Patent No.: US 9,293,247 B2
(45) Date of Patent: Mar. 22, 2016

(54) MAGNETICALLY BIASED AC INDUCTOR WITH COMMUTATOR

(71) Applicant: SMA Solar Technology AG, Niestetal (DE)

(72) Inventors: Jens Friebe, Vellmar (DE); Oliver Prior, Marsberg (DE); Peter Zacharias, Kassel (DE)

(73) Assignee: SMA SOLAR TECHNOLOGY AG, Niestetal (DE)

( * ) Notice: Subject to any disclaimer, the term of this patent is extended or adjusted under 35 U.S.C. 154(b) by 40 days.

(21) Appl. No.: 14/019,603

(22) Filed: Sep. 6, 2013

(65) Prior Publication Data

US 2014/0035711 A1 Feb. 6, 2014

Related U.S. Application Data

(63) Continuation of application No. PCT/EP2012/053365, filed on Feb. 28, 2012.

(30) Foreign Application Priority Data

Mar. 8, 2011 (DE) ..... 10 2011 001 147

(51) Int. Cl.
*H01F 17/00* (2006.01)
*H01F 27/04* (2006.01)
(Continued)

(52) U.S. Cl.
CPC ..... *H01F 27/42* (2013.01); *H01F 7/0205* (2013.01); *H01F 37/00* (2013.01); *H01F 2003/103* (2013.01)

(58) Field of Classification Search
CPC ..... H01F 27/40; H01F 27/402; B23K 3/0315; E21B 47/122; G01V 3/34
USPC ..... 336/105, 107, 110
See application file for complete search history.

(56) References Cited

U.S. PATENT DOCUMENTS 1,553,983 A 9/1925 Casper
2,774,935 A 12/1956 Rademakers et al.
(Continued)

FOREIGN PATENT DOCUMENTS

AT 258765 B 12/1967
CH 347110 A 6/1960
(Continued)

OTHER PUBLICATIONS

International Search Report & Written Opinion of the International Search Authority dated Jun. 25, 2012 for International Application No. PCT/EP2012/053365. 11 Pages.

*Primary Examiner* — Elvin G Enad
*Assistant Examiner* — Kazi Hossain
(74) *Attorney, Agent, or Firm* — Eschweiler & Associates, LLC

(57) ABSTRACT

An AC inductor includes a core, at least one permanent magnet for magnetically biasing the core, an inductor winding on the core, and a circuitry which guides an alternating current which flows through the AC inductor in such a way through the inductor winding that, during each half-wave of the alternating current, the alternating current generates a magnetization of the core which is opposite to the magnetization by the permanent magnet. This circuitry includes a commutator which guides the alternating current flowing between two contacts of the AC inductor through the same part of the inductor winding with a same flow direction during each of the half-wave of the alternating current.

8 Claims, 2 Drawing Sheets

(51) Int. Cl.

| | |
|---|---|
| ***H01F 21/00*** | (2006.01) |
| ***H02M 3/335*** | (2006.01) |
| ***H01F 27/42*** | (2006.01) |
| ***H01F 7/02*** | (2006.01) |
| ***H01F 37/00*** | (2006.01) |
| *H01F 3/10* | (2006.01) |

(56) References Cited

U.S. PATENT DOCUMENTS

| | | | | |
|---|---|---|---|---|
| 2,830,258 | A | 4/1958 | Conrath | |
| 2,994,027 | A | 7/1961 | Bennett et al. | |
| 3,242,386 | A | 3/1966 | Avery et al. | |
| 3,968,465 | A | 7/1976 | Fukui et al. | |
| 5,821,844 | A * | 10/1998 | Tominaga et al. | 336/110 |
| 6,590,485 | B2 | 7/2003 | Fujiwara et al. | |
| 6,639,499 | B2 * | 10/2003 | Okita et al. | 336/110 |
| 6,717,504 | B2 | 4/2004 | Fujiwara et al. | |
| 6,946,938 | B1 * | 9/2005 | Pedersen | 335/296 |
| 7,071,678 | B2 | 7/2006 | Karlsson et al. | |
| 7,499,291 | B2 * | 3/2009 | Han | 363/17 |
| 8,059,428 | B2 | 11/2011 | Laitinen et al. | |
| 8,064,225 | B2 | 11/2011 | Laitinen | |
| 8,350,654 | B2 * | 1/2013 | Tran | 336/110 |
| 2002/0050905 | A1 * | 5/2002 | Okita et al. | 336/110 |
| 2002/0158711 | A1 * | 10/2002 | Groves et al. | 333/174 |
| 2003/0002304 | A1 * | 1/2003 | Zhu et al. | 363/56.02 |
| 2003/0227363 | A1 * | 12/2003 | Leisten et al. | 336/178 |
| 2007/0223260 | A1 * | 9/2007 | Wang et al. | 363/52 |
| 2008/0018425 | A1 * | 1/2008 | Lu et al. | 336/84 C |
| 2008/0278985 | A1 * | 11/2008 | Ribarich | 363/127 |
| 2009/0009277 | A1 * | 1/2009 | Sodo | 336/110 |
| 2009/0206973 | A1 * | 8/2009 | Yabumi et al. | 336/110 |
| 2009/0231891 | A1 * | 9/2009 | Laitinen et al. | 363/44 |
| 2010/0027304 | A1 * | 2/2010 | Wang et al. | 363/126 |
| 2010/0039206 | A1 | 2/2010 | Klopcic et al. | |
| 2010/0246231 | A1 * | 9/2010 | Sirio et al. | 363/132 |
| 2012/0188803 | A1 * | 7/2012 | Trainer et al. | 363/37 |

FOREIGN PATENT DOCUMENTS

| | | | |
|---|---|---|---|
| CH | 666770 | A5 | 8/1988 |
| DE | 1758686 | U | 12/1957 |
| DE | 3732592 | A1 | 4/1989 |
| EP | 0343458 | A1 | 11/1989 |
| EP | 0705564 | A2 | 4/1996 |
| EP | 1081841 | A2 | 3/2001 |
| EP | 1211699 | A2 | 6/2002 |
| EP | 2104115 | A1 | 9/2009 |
| EP | 2104117 | A1 | 9/2009 |
| GB | 1480134 | A | 7/1977 |
| JP | 11150858 | A | 6/1999 |
| JP | 2006319176 | A | 11/2006 |

* cited by examiner

MAGNETICALLY BIASED AC INDUCTOR WITH COMMUTATOR

REFERENCE TO RELATED APPLICATIONS

This Application is a continuation of International Application number PCT/EP2012/053365 filed on Feb. 28, 2012, which claims priority to German Application number 10 2011 001 147.1 filed on Mar. 8, 2011.

FIELD

The present disclosure relates to an AC inductor comprising a core which is pre-magnetized or magnetically biased by at least one permanent magnet. Further, the disclosure relates to a method of operating such an AC inductor.

RELATED ART

The use of an inductor with a pre-magnetized core for DC applications is known for a long time, see, for example, DE 11 13 526 B. In these DC-applications, the pre-magnetization or magnetic bias of the core by means of a permanent magnet is oriented in a direction opposite to the magnetization which is generated by the direct current flowing through the inductor winding. In this way, the magnetic operation range of the core of the inductor is shifted with regard to the saturation limits of its magnetization. Thus, a smaller core is sufficient as compared to an inductor without magnetic bias.

An inductor with a magnetically biased core is not directly useable in AC applications, because the direction of the magnetization of the core generated by the alternating current flowing through the inductor winding changes with each change of the current flow direction between the half-waves of the alternating current. Thus, there is no direction of the magnetic bias of the core which could shift the operation range of the inductor with regard to the magnetic saturation of its core in a suitable way for both alternating directions of an AC current simultaneously.

EP 2 104 115 A1 discloses an AC inductor comprising a magnetically biased core in which the inductor winding is divided into two partial windings. An alternating current flowing through the AC inductor is alternatingly, i.e. half-wave by half-wave, guided through one of the two partial windings which comprise opposite winding directions so that the alternating current generates a magnetization of the core of the AC inductor in the same direction during each of its half-waves. Due to this, the magnetic operation range of the AC inductor may be shifted with regard to the saturation limits by means of the permanent magnet in a suitable way. The circuitry which in this known AC inductor switches the alternating current between the two partial windings of the inductor winding also serves for rectifying this alternating current into a direct current and/or for generating an alternating current from a direct current. Because of the two separate partial windings of the inductor winding, the advantages of a pre-magnetized core, particularly the reduction in volume, can not be fully exploited in this known inductor.

SUMMARY

The present disclosure provides an inductor and a method of operating an inductor which make full use of a magnetically biased core, particularly with regard to the reduction in volume, also for AC applications.

The AC inductor according to the present disclosure comprises a core, at least one permanent magnet for magnetically biasing the core, an inductor winding on the core and a circuitry which guides an alternating current flowing through the AC inductor through the inductor winding in such a way that it generates a magnetization of the core in an opposite direction to the magnetic bias by the permanent magnet during each half-wave of the alternating current. To achieve this goal according to the present disclosure, the circuitry includes a commutator which guides the alternating current which flows between two contacts of the AC inductor through a same part of the inductor winding and at a same current flow direction during both half-waves of the alternating current.

The commutator of the AC inductor according to the present disclosure changes the connection direction of the inductor winding prior to each half-wave of the alternating current. Thus, DC current pulses flow through the same inductor winding of the AC inductor and are afterwards rearranged for forming the alternating current once again, half-wave by half-wave. The inductor winding and the core on which the winding is wound and which is magnetically biased by the permanent magnet may thus be designed and optimized like in a known inductor with magnetically biased core for DC applications.

In one embodiment, the inductor winding of the new AC inductor only comprises two contacts and the commutator alternatingly connects these two contacts of the AC inductor to the two contacts of the inductor winding in an electrically conductive way. This step of connecting in an electrically conductive way by means of the commutator may partially be accomplished by passively switching elements, like for example rectifier diodes. A blocking or non-conductive rectifier diode is not considered as an electrically conductive connection here.

In a more detailed embodiment, the commutator of the AC inductor according to the present disclosure comprises a bidirectional switch, i.e. a switch capable of blocking currents in both directions, in each of its four branches extending between the two contacts of the AC inductor and the two contacts of the inductor winding. During each half-wave of the alternating current, two of these four switches are opened whereas the other two are closed (wherein the respective closed switches are not connected in series between the contacts of the AC inductors), so that the commutator defines the current flow direction through the inductor winding.

Instead of four bidirectional switches, the commutator may comprise four unidirectional switches each connected in series with a current rectifier oriented in a blocking direction of the respective opened unidirectional switch. The current rectifiers block the current in an undesired current flow direction through the switches which only block unidirectionally here.

In one embodiment the switches of the commutator of the AC inductor according to the present disclosure are semiconductor switches. Those skilled in the art have knowledge of both bidirectional switches and unidirectional switches in various embodiments.

In the AC inductor according to the present disclosure, an additional pre-magnetization restoration circuitry may be provided to subject a magnetization winding around the permanent magnet to a magnetization current pulse which generates a magnetization having the same direction as the magnetization of the permanent magnet and having a field strength which exceeds the magnetization field strength of the permanent magnet. The pre-magnetization restoration circuitry is thus able to restore the magnetization of the permanent magnet if it has declined for any reason.

Advantageous developments of the disclosure result from the claims, the description and the drawings. The advantages of features and of combinations of a plurality of features mentioned at the beginning of the description only serve as examples and may be used alternatively or cumulatively without the necessity of embodiments according to the disclosure having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the disclosure or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the disclosure do not have the features mentioned in the claims.

BRIEF DESCRIPTION OF THE DRAWINGS

In the following, the disclosure will be further explained and described by means of embodiments of an AC inductor with reference to the attached drawings.

DETAILED DESCRIPTION

Figure 1:
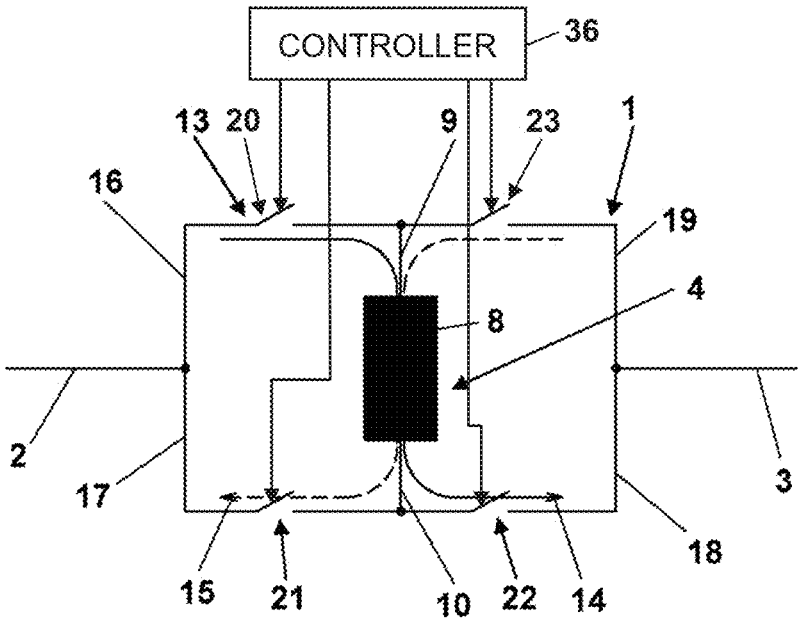
FIG. 1 is a circuit diagram of a first embodiment of the AC inductor according to the present disclosure.
Figure 2:
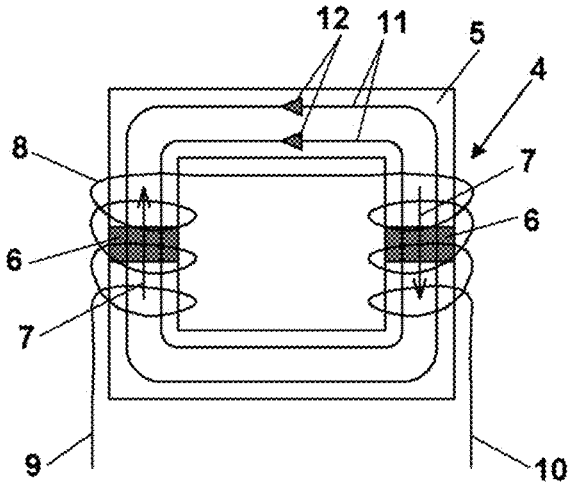
FIG. 2 illustrates the permanent magnet which is magnetically biased by permanent magnets and the inductor winding arranged on the core of the AC inductor according to FIG. 1.

The AC inductor 1 depicted in FIG. 1 comprises two contacts 2 and 3. The AC inductor 1 is provided for AC applications in which an alternating current (AC) flows during one half-wave from contact 2 to contact 3 and during the other half-wave from contact 3 to contact 2. The AC inductor 1 comprises an inductor coil 4 for which one embodiment is depicted in FIG. 2. The inductor coil 4 comprises a core 5 which, by means of permanent magnets 6 is magnetically biased in a direction indicated by arrows 7, and an inductor winding 8 wound around the core 5. When a current flows between the contacts 9 and 10 of the inductor winding, a magnetic field is generated in the core 5. FIG. 2 shows lines of magnetic flux 11 of this magnetic field, arrow tips 12 indicating the direction of the magnetic field through the ring-shaped core 5. This direction is opposite to the direction of the pre-magnetization of the core 5 by the permanent magnets 6. For this reason, a magnetic saturation of the core 5 is only reached at higher currents between the contacts 9 and 10. This, however, only applies for currents of one current flow direction between the contacts 9 and 10.

Figure 3:
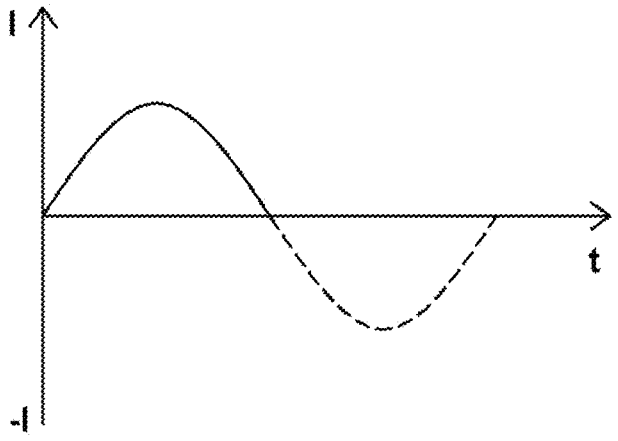
FIG. 3 shows the time course of the current of a sine-shaped alternating current over as it flows through the AC inductor according to FIG. 1.

In an alternating current the current flow direction changes from half-wave to half-wave as shown in FIG. 3 which depicts the time course of the current I for an alternating current. Here, the course for the first positive half-wave of the alternating current is depicted with a full line and for the second negative half-wave of the alternating current with a dashed line.

The AC inductor 1 according to FIG. 1 comprises a commutator 13, which alternatingly connects the contacts 9 and 10 of the inductor coil 4 half-wave by half-wave to the contacts 2 and 3 of the AC inductor 1 so that the alternating current always flows in the same current flow direction between the contacts 9 and 10 through the inductor winding 8. In FIG. 1, the current paths between the contacts 2 and 3 of the AC inductor are depicted for the first half-wave with a full line and with an arrow tip 14 pointing from contact 2 to contact 3 of the alternating current according to FIG. 3, and for the second half-wave with a dashed line and with an arrow tip 15 pointing from the contact 3 to the contact 2. To conduct the current in such a way half-wave by half-wave, the commutator 13, in its four branches 16 to 19 between the contacts 2 and 3 on the one hand and the contacts 9 and 10 on the other hand, comprises four switches 20 to 23 which are made as bidirectional switches here which are able to block current in both directions. Activated by a controller 36, the switches 20 and 22 of the switches 20 to 23 are closed during the first half-wave of the alternating current, whereas the switches 21 and 23 are open at that time, Vice versa, the controller 36 activates the switches 21 to 23 such that the switches 23 and 21 are closed whereas the switches 20 and 22 are open during the second half-wave of the alternating current according to FIG. 3. Since only a pulsed direct current, i.e. a current always having the same current flow direction, flows through the inductor coil 4 or the inductor winding 8 according to FIG. 2, the inductor coil 4 with the core 5 magnetically biased in a fixed direction by means of the permanent magnets 6 may, due to the better exploration of the material of the core 5, be made smaller than an inductor coil 4 through the inductor winding of which an alternating current flows with changing current flow direction. This is achieved with the inductor coil 4 comprising only a single inductor winding 8 on the core 5.

Figure 4:
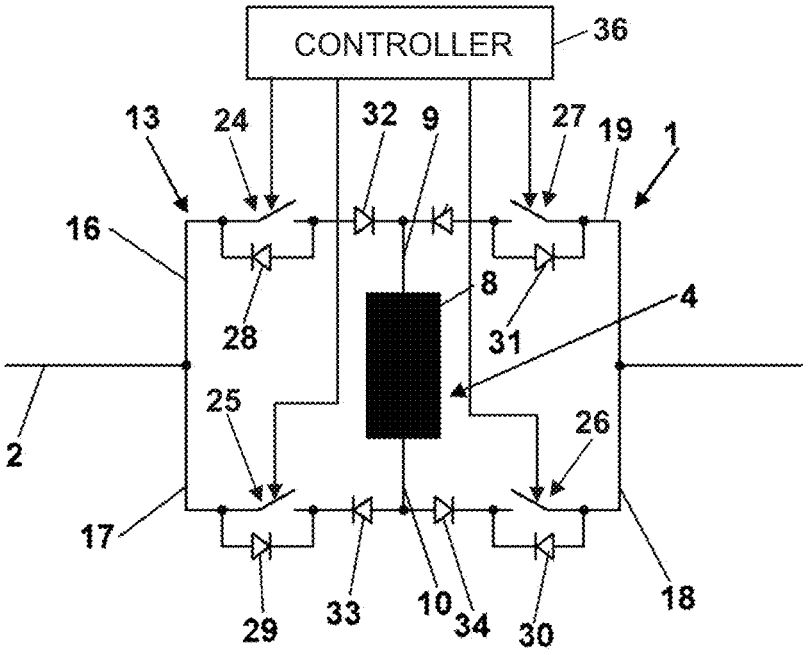
FIG. 4 is a circuit diagram of a second embodiment of the AC inductor according to the present disclosure.

FIG. 4 shows an embodiment of the AC inductor 1 in which the commutator 13 does not comprise bidirectional switches in its branches 16 to 19, but switches 24 to 27 which, when activated by the controller 36, only block in one direction in their opened state while conducting in the opposite direction, which is indicated by depicting inherent anti-parallel diodes 28 to 31 of the switches 24 to 27. In the individual branches 16 to 19, the switches 24 to 27 are each connected in series with a rectifier diode 32 to 35, the conductive direction of which is opposite to the conductive direction of the inherent anti-parallel diodes 28 to 31 of the respective switches 24 to 27. The commutator 13, when operated with switches 24 and 26 being closed and switches 27 and 29 being open during the positive half-waves of the alternating current, connects the contact 2 to the contact 9 and the contact 10 to the contact 3, whereas, when operated with switches 27 and 29 being closed and switches 24 and 26 being open during the negative half-waves of the alternating current, it connects the contact 3 to the contact 9 and the contact 10 to the contact 2. Here, the conductive directions of the rectifier diodes 32 and 35 always point in the current flow direction through the respective branch 16 to 19 of the commutator 13.

The invention claimed is:

1. An AC inductor, comprising:

a core;

at least one permanent magnet configured to magnetically bias the core;

an inductor winding on the core, wherein the inductor winding comprises two contacts; and a circuitry configured to guide an alternating current flowing through the inductor winding such that the current flowing through the inductor winding generates a magnetization of the core which is opposite to the magnetization by the permanent magnet, wherein the circuitry includes a commutator configured to guide the alternating current flowing between two contacts of the AC inductor through a same part of the inductor winding with a same current flow direction during each half-wave of the alternating current, wherein the commutator is configured to alternatingly connect the two contacts of the AC inductor with the two contacts of the inductor winding in an electrically conductive way, and wherein the commutator comprises four branches between the two contacts of the AC inductor and the two contacts of the inductor winding and an unidirectional switch connected in series with a current rectifier pointing in a blocking direction of the opened unidirectional switch in each of the four branches.

2. The AC inductor of claim 1, wherein the current rectifiers are rectifier diodes.

3. The AC inductor of claim 1, wherein the switches are semiconductor switches.

4. The AC inductor of claim 1, further comprising a pre-magnetization restoring circuitry configured to subject a magnetization winding around the permanent magnet to a magnetization current pulse which generates a magnetization in a same direction as the magnetization of the permanent magnet and having a field strength exceeding the magnetizing field strength of the permanent magnet.

5. A method of operating an AC inductor comprising a core, at least one permanent magnet configured to pre-magnetize the core, an inductor winding on the core and a commutator which comprises four branches between two contacts of the AC inductor and two contacts of the inductor winding, and one switch in each of its four branches, comprising:

alternately opening and closing the switches in pairs so that an alternating current flowing between the two contacts of the AC inductor flows with a same current flow direction between the contacts of the inductor winding during each half-wave of the alternating current; and providing a current rectifier in series with a switch in each of the four branches, wherein a conductive direction of each current rectifier points in the current flow direction of its respective branch.

6. The method of claim 5, wherein a magnetization winding around the permanent magnet is subjected to a magnetization current pulse when a magnetic saturation of the AC inductor is registered such that the magnetization pulse generates a magnetization having a same direction as the magnetization of the permanent magnet and a field strength exceeding the magnetizing field strength of the permanent magnet.

7. An AC inductor, comprising:

a core having one or more permanent magnets associated therewith configured to magnetically bias the core in a first direction;

an inductor winding on the core having a first contact and a second contact, wherein the inductor winding is configured to conduct a winding current through the first and second contacts thereof; and commutation circuitry comprising first and second contacts configured to conduct an alternating current through the first and second contacts thereof, wherein the commutation circuitry is configured to direct the alternating current during a first half cycle thereof in a first path to form the winding current conducting through the first and second contacts of the inductor winding in a second direction, and wherein the commutation circuitry is configured to direct the alternating current during a second half cycle thereof in a second, different path to form the winding current conducting through the first and second contacts of the inductor winding in the second direction, wherein the commutation circuitry comprises:

an H-bridge circuit comprising a first pair of series-connected switches connected together at a first node, and a second pair of series-connected switches connected together at a second node, wherein the first and second contacts of the inductor winding are connected to the first node and the second node, respectively, and wherein each series-connected switch in the first and second pair of series-connected switches is connected in series with a current rectifier oriented in a blocking direction of its respective series-connected switch when such series-connected switch is open; and a controller configured to concurrently activate a first switch of the first pair of switches and a second switch of the second pair of switches, and deactivate a second switch of the first pair of switches and a first switch of the second pair of switches during the first half cycle of the alternating current, and wherein the controller is further configured to concurrently activate the second switch of the first pair of switches and the first switch of the second pair of switches, and deactivate the first switch of the first pair of switches and the second switch of the second pair of switches during the second half cycle of the alternating current, thereby forcing current through the first and second contacts of the inductor winding in the second direction in both the first half cycle and the second half cycle of the alternating current.

8. The AC inductor of claim 7, wherein the first direction and the second direction are opposite one another.

* * * * *